US011815248B1

(12) United States Patent
Hu et al.

(10) Patent No.: US 11,815,248 B1
(45) Date of Patent: Nov. 14, 2023

(54) INTEGRATED LAMP PANEL FACE FRAME, AND INTEGRATED NON-FACE FRAME PANEL LIGHT AND ASSEMBLING METHOD THEREOF

(71) Applicants: Xmart Lighting Co., Ltd., Guangdong (CN); Gengu Huang, Guangdong (CN)

(72) Inventors: Zhongxiao Hu, Guangdong (CN); Shaosong Huang, Guangdong (CN); Gengu Huang, Guangdong (CN); Wei Wang, Guangdong (CN)

( * ) Notice: Subject to any disclaimer, the term of this patent is extended or adjusted under 35 U.S.C. 154(b) by 0 days.

(21) Appl. No.: 17/963,206

(22) Filed: Oct. 11, 2022

(30) Foreign Application Priority Data

Sep. 9, 2022 (CN) ..... 202222415361.5

(51) Int. Cl.
*F21V 19/00* (2006.01)
*F21V 15/01* (2006.01)
*F21Y 115/10* (2016.01)

(52) U.S. Cl.
CPC ..... *F21V 19/0015* (2013.01); *F21V 15/01* (2013.01); *F21Y 2115/10* (2016.08)

(58) Field of Classification Search
CPC ..... F21V 19/0015; F21V 15/01
See application file for complete search history.

(56) References Cited

U.S. PATENT DOCUMENTS

| | | | | |
|---|---|---|---|---|
| D907,833 | S * | 1/2021 | Xie | D26/80 |
| D945,678 | S * | 3/2022 | Ambrozus | D26/118 |
| 11,313,545 | B1 * | 4/2022 | Jiang | F21V 23/009 |
| D960,422 | S * | 8/2022 | Lu | D26/74 |
| D971,478 | S * | 11/2022 | Pi | D26/74 |
| 2012/0051050 | A1 * | 3/2012 | Lee | F21V 17/10 362/235 |
| 2021/0247049 | A1 * | 8/2021 | Lu | F21V 7/05 |
| 2022/0136680 | A1 * | 5/2022 | Zhang | F21V 5/007 362/362 |

* cited by examiner

*Primary Examiner* — Christopher E Dunay

(57) ABSTRACT

The present disclosure relates to an integrated lamp panel face frame, and an integrated non-face frame panel light and an assembling method thereof. The integrated lamp panel face frame includes an integrally molded lamp panel, a base plate of the lamp panel and four side walls of the lamp panel are inclined, a deformable pressing groove protrudes towards outer walls of the lamp panel along inner walls of the side walls of the lamp panel for installing a diffusion plate, and a face frame installation part is provided by bending ends of the side walls of the lamp panel towards the base plate of the lamp panel. According to the integrated lamp panel face frame of the present disclosure, since the side walls of the lamp panel are inclined, lamp panels can be stacked directly during packaging and transportation, thereby decreasing the transportation dimension and reducing the transportation cost.

11 Claims, 20 Drawing Sheets

INTEGRATED LAMP PANEL FACE FRAME, AND INTEGRATED NON-FACE FRAME PANEL LIGHT AND ASSEMBLING METHOD THEREOF

BACKGROUND OF THE INVENTION

The present disclosure relates to the technical field of lighting fixtures, in particular to an integrated lamp panel face frame, and an integrated non-face frame panel light and an assembling method thereof.

As an alternative to early grille lights, panel lights are more and more popular among users. LED panel lights are widely used in the field of indoor lighting because they have soft, comfortable and bright light, and can effectively relieve eye fatigue.

A traditional LED panel light generally includes a base plate, an LED light source disposed on the base plate, and a face frame and a diffusion plate matched with the base plate, and the base plate and the face frame thereof are produced separately. When the LED light source is installed, generally, a plurality of light strips are arranged in a matrix, then each light strip is glued to or installed on a lamp panel with fixing parts, and the lamp panel is then installed on the base plate with fasteners such as screws. When the face frame and the diffusion plate are installed, the base plate, the face frame and the diffusion plate are fixed with 20-40 screws, during which a screw machine or manual screwing is required, such that the efficiency is low, and two screw machines are required to operate at the same time. In the assembling process, since the diffusion plate is assembled in the assembling phase, dust and foreign matter are more prone to entering a light body in the subsequent process, and are difficult to clean up. Therefore, there are many processes in the manufacturing process, the production efficiency is low, and lights of the structure have poor stability and are prone to damage.

In addition, in the process of packaging and transportation, products need to be packaged in cartons for protection. Each product should be separated and protected by polylon corner guards to avoid scratches on the product surface, such that the transportation size is large, and the packaging cost and transportation cost are high.

Therefore, in order to solve the above problems of the LED panel lights, and to simplify the manufacturing process and installation process, the base plate and the face frame are integrated. For example, the patent "INTEGRATED PANEL LIGHT" is disclosed as: An integrated panel light includes a lamp panel, an edge buckle is fixedly connected to a peripheral side of the lamp panel, and is integrated with the lamp panel, a buckle groove is provided in an upper portion of an inner wall of the lamp panel, and a diffusion plate is buckled to the buckle groove, such that clamped connection of the diffusion plate is achieved.

In the patent, the integrated design of the lamp panel and the face frame is achieved, and installation of the diffusion plate is also achieved by designing the buckle groove. However, since the diffusion plate is light and thin, the width or depth of the buckle groove is greater than the thickness of the diffusion plate in order to install the diffusion plate without damage, which may affect the installation stability of the diffusion plate and airtightness between the diffusion plate and the lamp panel. Therefore, a sealing gasket is glued and fixed at the edge of the diffusion plate to solve the above problems.

Therefore, in the design, although the diffusion plate does not need to be fixed with screws for installation, the sealing gasket is used as an accessory to adapt to installation thereof, and the installation process of the diffusion plate is not completely simplified. In addition, although the edge buckle fixedly connected to the peripheral side of the lamp panel is used as an installation face frame, and buckle protrusions disposed in the middle of the edge buckle facilitate installation of the panel light, the panel lights can only be packaged separately instead of being stacked, resulting in a large transportation size and high packaging cost and transportation cost.

BRIEF SUMMARY OF THE INVENTION

In order to solve the problem that in the prior art, although a diffusion plate does not need to be fixed with screws for installation, a sealing gasket is used as an accessory to adapt to installation thereof, and the installation process of the diffusion plate is not completely simplified, as well as the problem that lamp panels can only be packaged separately instead of being stacked during packaging and transportation, resulting in a large transportation size and high packaging cost and transportation cost, the present disclosure provides an integrated lamp panel face frame, and an integrated non-face frame panel light and an assembling method thereof.

An integrated lamp panel face frame, includes an integrally molded lamp panel, a base plate of the lamp panel and four side walls of the lamp panel are inclined, a deformable pressing groove protrudes towards outer walls of the lamp panel along inner walls of the side walls of the lamp panel for installing a diffusion plate, and a face frame installation part is provided by bending ends of the side walls of the lamp panel towards the base plate of the lamp panel.

Further, as a preferred technical solution, the pressing groove is provided in parallel with the base plate of the lamp panel, and a cross section of the pressing groove is in a U shape.

Further, as a preferred technical solution, a width of the pressing groove is greater than a thickness of the diffusion plate.

Further, as a preferred technical solution, slope notches are provided in four corners of the face frame installation part.

Further, as a preferred technical solution, an installation groove is provided in the base plate of the lamp panel and protrudes outward along an inner wall of the base plate, a plurality of reinforcing protrusion structures are provided on the installation groove and protrude toward interior of the lamp panel, and an annular reinforcing convex rib is provided on the base plate of the lamp panel and protrudes outward along the installation groove.

Further, as a preferred technical solution, the plurality of reinforcing protrusion structures are distributed on the installation groove in an array.

An integrated non-face frame panel light, includes the above integrated lamp panel face frame, a diffusion plate and an LED light source, the diffusion plate is embedded in a pressing groove of the integrated lamp panel face frame, and the LED light source is fixedly installed in an installation groove of the integrated lamp panel face frame.

Further, as a preferred technical solution, the LED light source includes a plurality of strip light panels, the plurality of strip light panels are disposed in parallel, and every two adjacent strip light panels are spaced by a column or a row of reinforcing protrusion structures.

Further, as a preferred technical solution, the integrated non-face frame panel light further includes installation spring buckles, one ends of the installation spring buckles are fixedly connected to a face frame installation part, and the other ends of the installation spring buckles are bent horizontally to form clasps.

Further, as a preferred technical solution, the integrated non-face frame panel light further includes a driving power box, the driving power box is connected to the LED light source, and the driving power box is installed at a face frame installation part of the integrated lamp panel face frame and fixedly connected to the integrated lamp panel face frame.

An assembling method of an integrated non-face frame panel light is used for assembling the above integrated non-face frame panel light, and includes the following steps:

- installing a plurality of strip light panels of an LED light source in an installation groove of a lamp panel fixedly and sequentially;
- installing a diffusion plate in a pressing groove, and pressing the pressing groove, such that an upper inner surface and a lower inner surface of the pressing groove are attached to an upper surface and a lower surface of the diffusion plate respectively after pressing;
- installing a driving power box at a face frame installation part of an integrated lamp panel face frame fixedly; and
- connecting installation spring buckles to the face frame installation part of the integrated lamp panel face frame fixedly.

Compared with the prior art, the technical solution of the present disclosure has the beneficial effects:

According to the integrated lamp panel face frame of the present disclosure, integration of the lamp panel and the face frame is achieved through the face frame installation part formed by bending the ends of the side walls of the lamp panel towards the base plate of the lamp panel, such that the cost of the face frame is saved, and as there is no face frame, investment devices such as screw machines are omitted, and the assembling efficiency is improved. Since the sidewalls of the lamp panel are inclined, lamp panels can be stacked directly during packaging and transportation, thereby minimizing the packaging dimension, decreasing the transportation dimension, and reducing transportation cost and transshipment cost. By providing the deformable pressing groove to install the diffusion plate, the assembling process is simplified, dust and foreign matter are prevented from entering the panel light, and product quality is improved.

According to the integrated non-face frame panel light of the present disclosure, by using the integrated lamp panel face frame, the assembling process is optimized, the assembling efficiency and product quality are improved, the transportation dimension is decreased, and the transportation cost and transshipment cost are reduced.

By assembling the integrated non-face frame panel light according to the assembling method of the integrated non-face frame panel light, the assembling process is simplified, the number of assembling accessories is reduced, the assembling efficiency is improved, and the product quality is also improved.

DETAILED DESCRIPTION OF THE INVENTION

Figure 1:
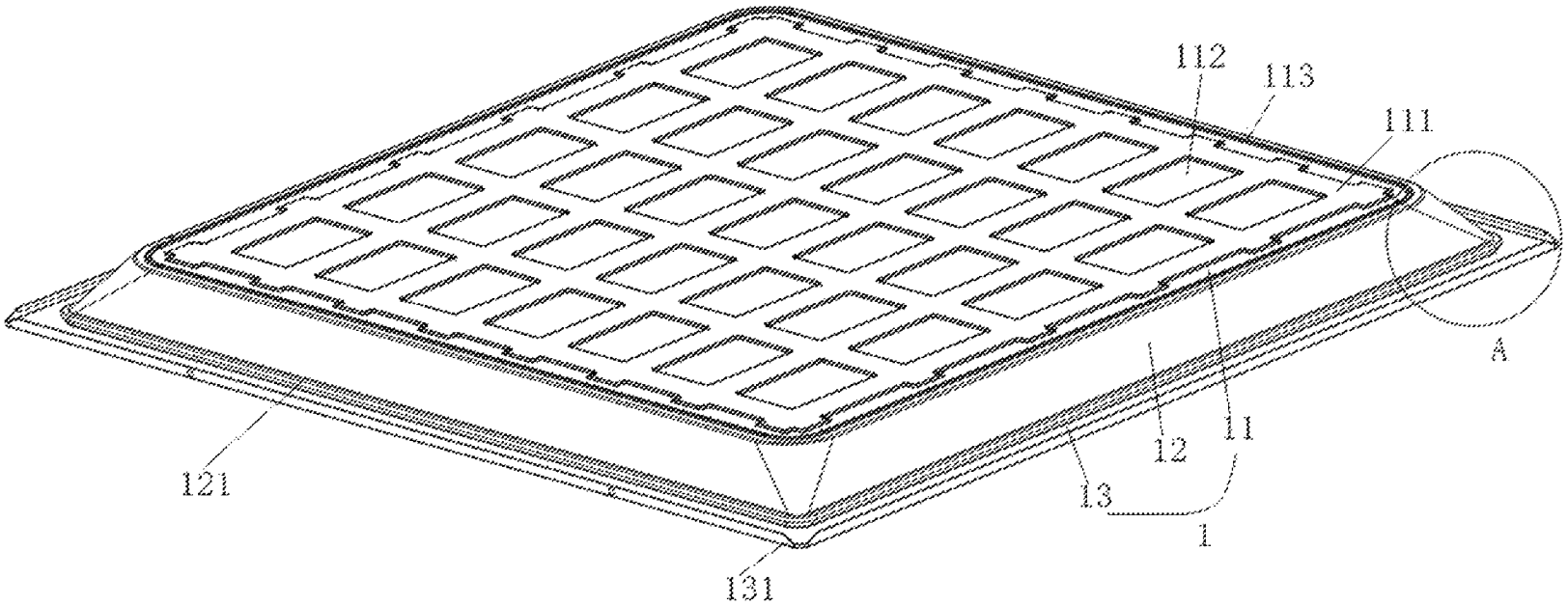
FIG. 1 is a schematic structural diagram of an integrated lamp panel face frame according to the present disclosure.
Figure 2:
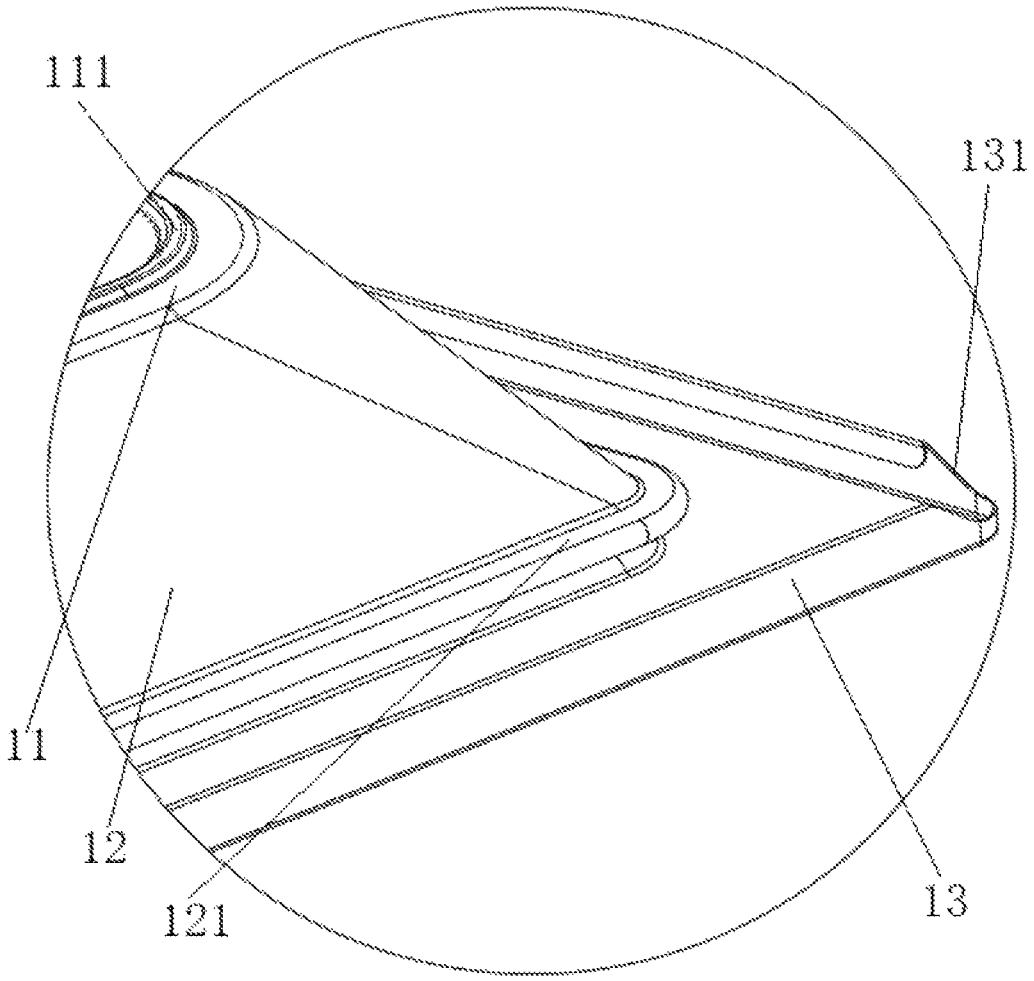
FIG. 2 is a structural enlarged view of A in an integrated lamp panel face frame according to the present disclosure.
Figure 3:
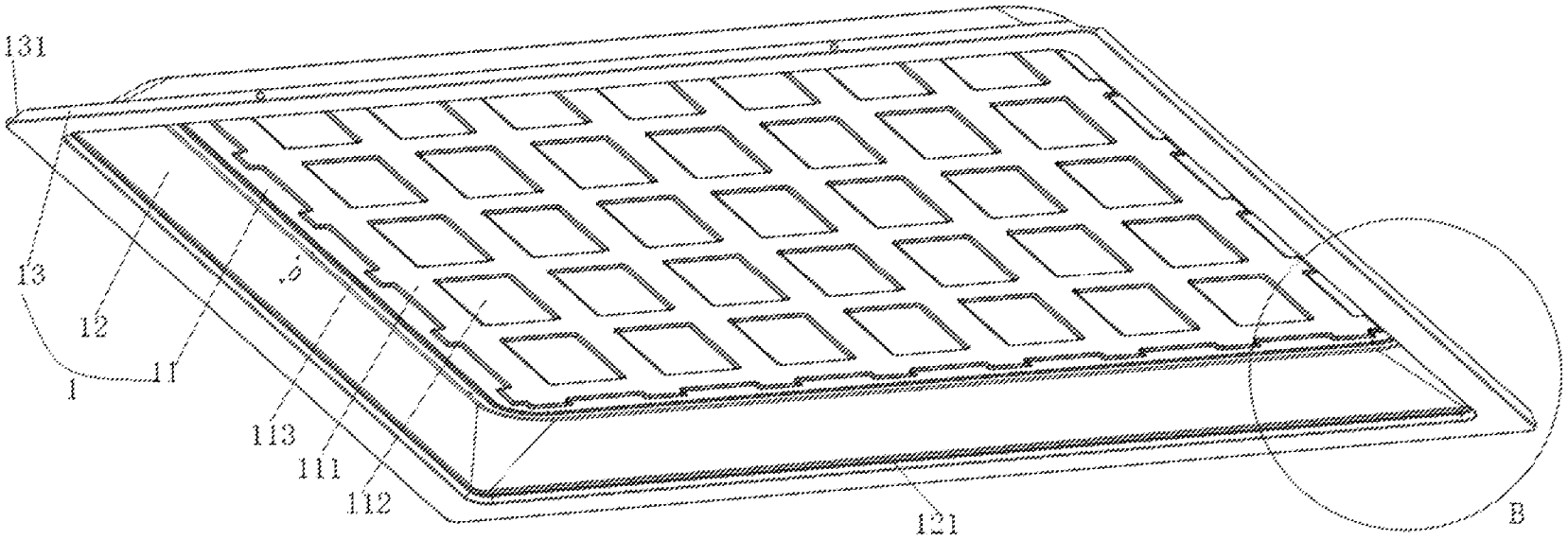
FIG. 3 is a schematic bottom view of an integrated lamp panel face frame according to the present disclosure.
Figure 4:
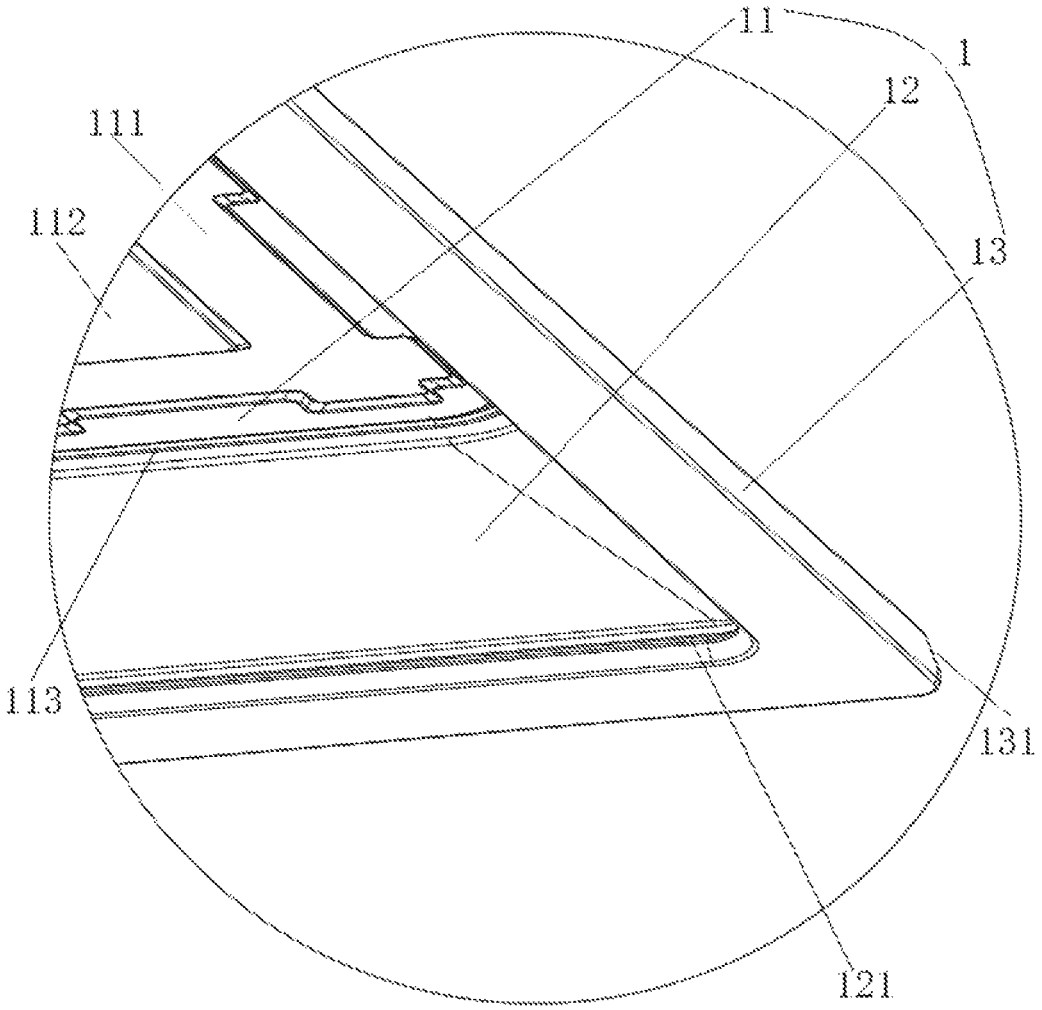
FIG. 4 is a structural enlarged view of B in an integrated lamp panel face frame according to the present disclosure.
Figure 5:
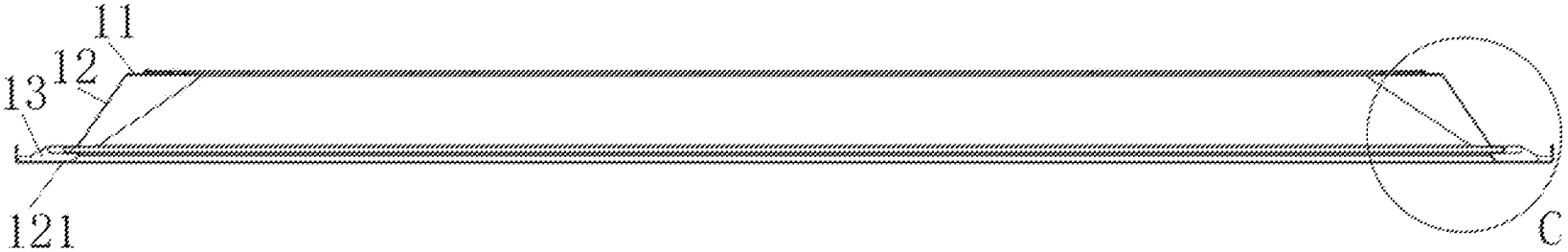
FIG. 5 is a schematic front cross-sectional view of an integrated lamp panel face frame according to the present disclosure.
Figure 6:
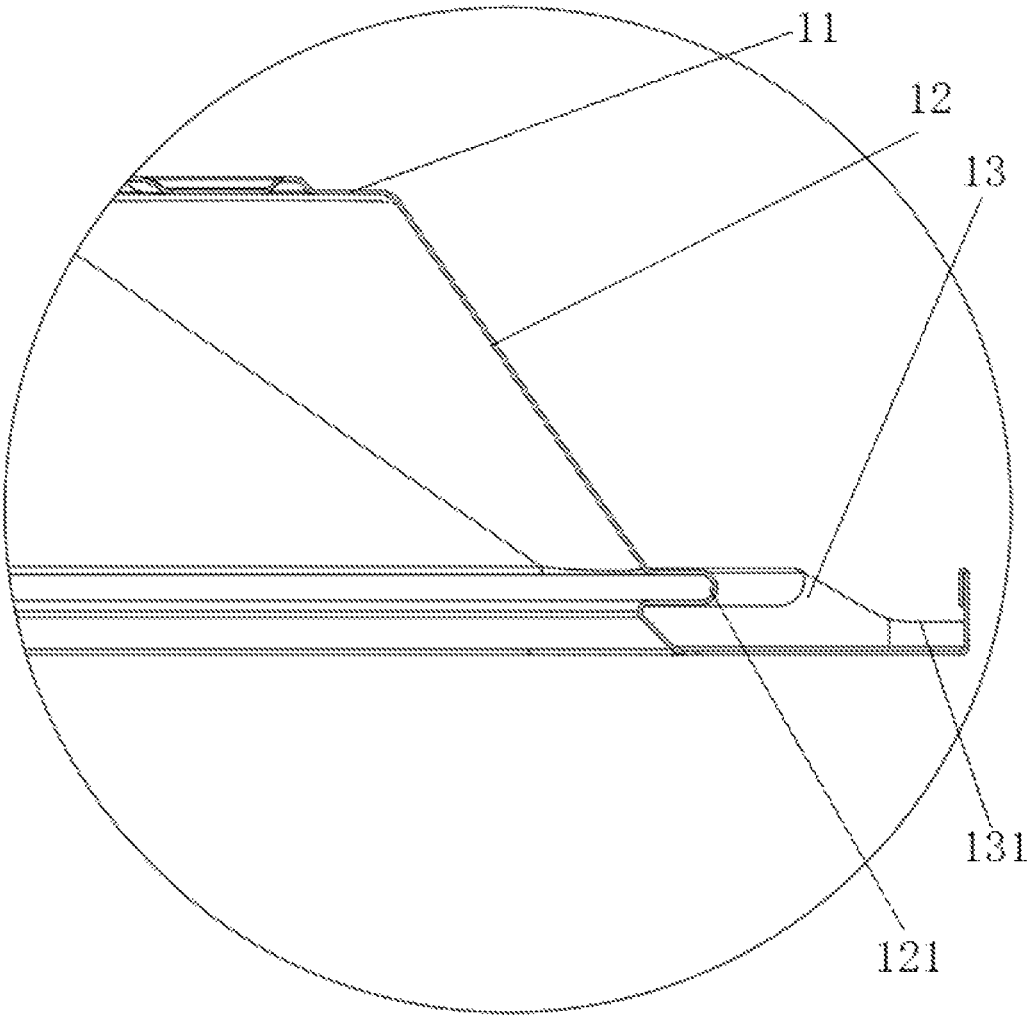
FIG. 6 is a structural enlarged view of C in an integrated lamp panel face frame according to the present disclosure.

The present disclosure will be further illustrated below in conjunction with the implementations.

The same or similar numbers in the accompanying drawings of the embodiments of the present disclosure correspond to the same or similar components. In the description of the present disclosure, it should be understood that the terms "upper", "lower", "left", "right", "top", "bottom", "inside", "outside", etc. indicate orientations or positional relationships based on the orientations or positional relationships shown in the accompanying drawings, and are merely for the convenience of describing the present disclosure and simplifying the description, rather than indicating or implying that the referred devices or components must have a specific orientation, be constructed and operated in a specific orientation, so the terms describing the positional relationship in the accompanying drawings are for illustrative purposes merely and should not be construed as limitations on the patent.

In addition, terms "first", "second", etc. are used for descriptive purposes merely, primarily to distinguish between different devices, components or parts (specific types and configurations may be the same or different), not to indicate or imply relative importance and number of the referred devices, components or parts, and thus they should not be construed as indicating or implying relative importance.

Embodiment 1

The embodiment discloses an integrated lamp panel face frame. Integration of a lamp panel and the face frame is achieved, a diffusion plate is installed without using accessories, and the installation process is simplified.

As shown in FIG. 1 to FIG. 4, the integrated lamp panel face frame includes an integrally molded lamp panel 1, a base plate 11 of the lamp panel 1 and four side walls 12 of the lamp panel 1 are inclined, a deformable pressing groove 121 protrudes towards outer walls of the lamp panel 1 along inner walls of the side walls 12 of the lamp panel 1 for installing a diffusion plate 2, and a face frame installation part 13 is provided by bending ends of the side walls 12 of the lamp panel 1 towards the base plate 11 of the lamp panel 1.

In the embodiment, an inclination angle between the base plate 11 of the lamp panel 1 and the four side walls 12 of the lamp panel 1 is greater than 90 degrees, that is, the cross section of the lamp panel 1 is a trapezoid. Since the base plate 11 and the four side walls 12 of the lamp panel 1 are inclined, lamp panels can be directly stacked during packaging and transportation, which is similar to stacking bowls, thereby minimizing the packaging dimension, decreasing the transportation dimension, and reducing the transportation cost and transshipment cost.

In addition, integration of the lamp panel and the face frame is achieved through the U-shaped face frame installation part 13 formed by bending the ends of the side walls 12 of the lamp panel 1 towards the base plate 11 of the lamp panel 1, such that the cost of the face frame is saved, and as there is no face frame, investment devices such as screw machines are omitted, and the assembling efficiency is improved. Slope notches 131 are provided in four corners of the face frame installation part 13, which further facilitates the packaging and stacking of the lamp panel 1, and also facilitates stretching during production and processing of the lamp panel 1, thereby preventing the lamp panel from wrinkling and ensuring the production quality of the product.

At the same time, by providing the deformable pressing groove 121 to install the diffusion plate 2, the assembling process is simplified, dust and foreign matter are prevented from entering the lamp panel 1, and product quality is improved.

Figure 7:
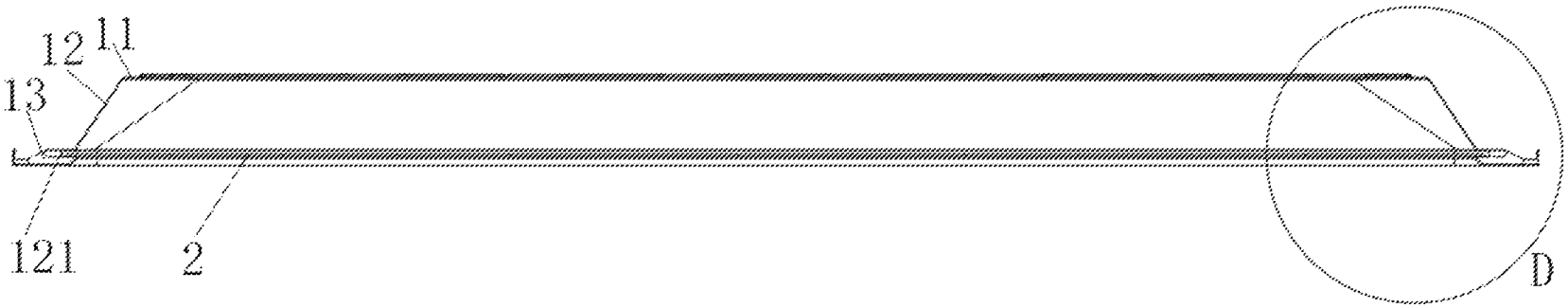
FIG. 7 is a schematic front cross-sectional view of an integrated lamp panel face frame after installation of a diffusion plate according to the present disclosure.
Figure 8:
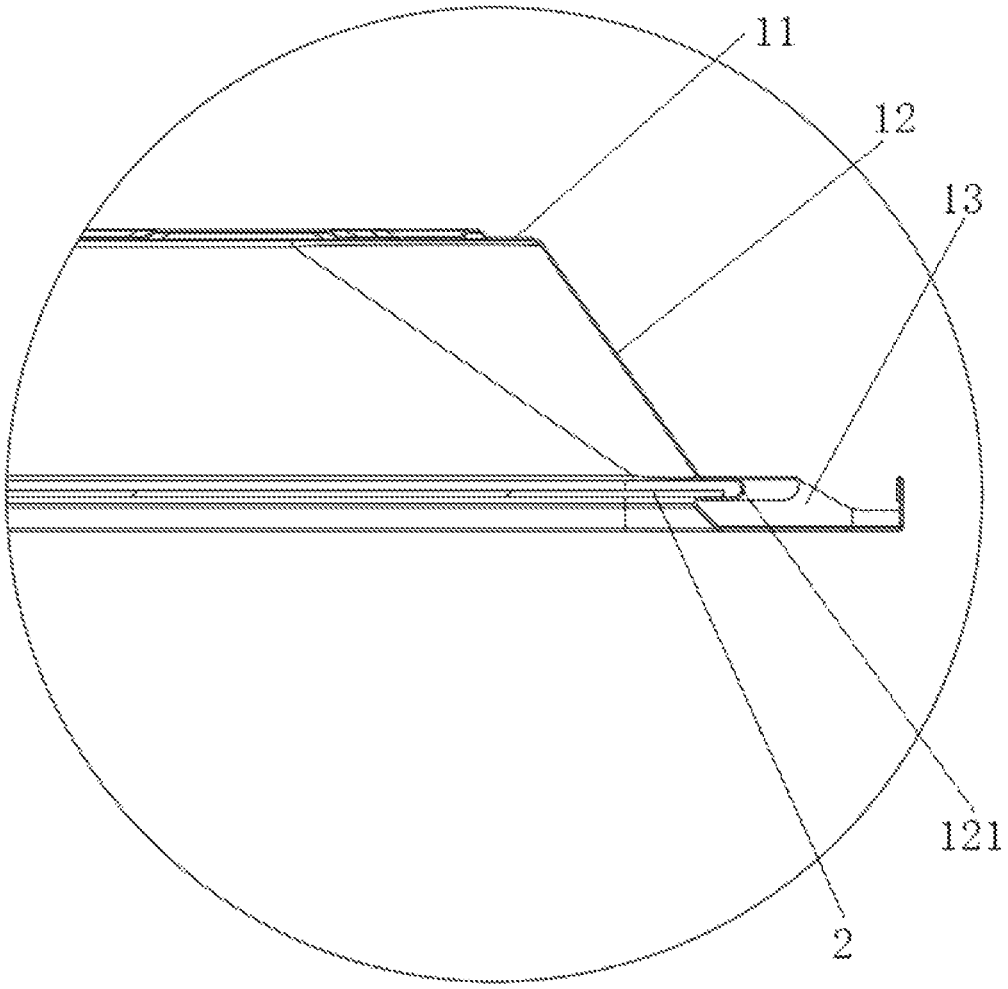
FIG. 8 is a structural enlarged view of D in an integrated lamp panel face frame during installation of a diffusion plate according to the present disclosure.

In the embodiment, as shown in FIG. 7 and FIG. 8, the pressing groove 121 is provided in parallel with the base plate 11 of the lamp panel 1 to achieve horizontal installation of the diffusion plate 2, a width of the pressing groove 121 is greater than a thickness of the diffusion plate 2 to facilitate the installation of the diffusion plate 2, a cross section of the pressing groove 121 is U-shaped, which further facilitates the installation of the diffusion plate 2, and after the diffusion plate 2 is installed, pressing may be performed base on a radial center line of the pressing groove 121 so as to better achieve a pressing effect.

Figure 9:
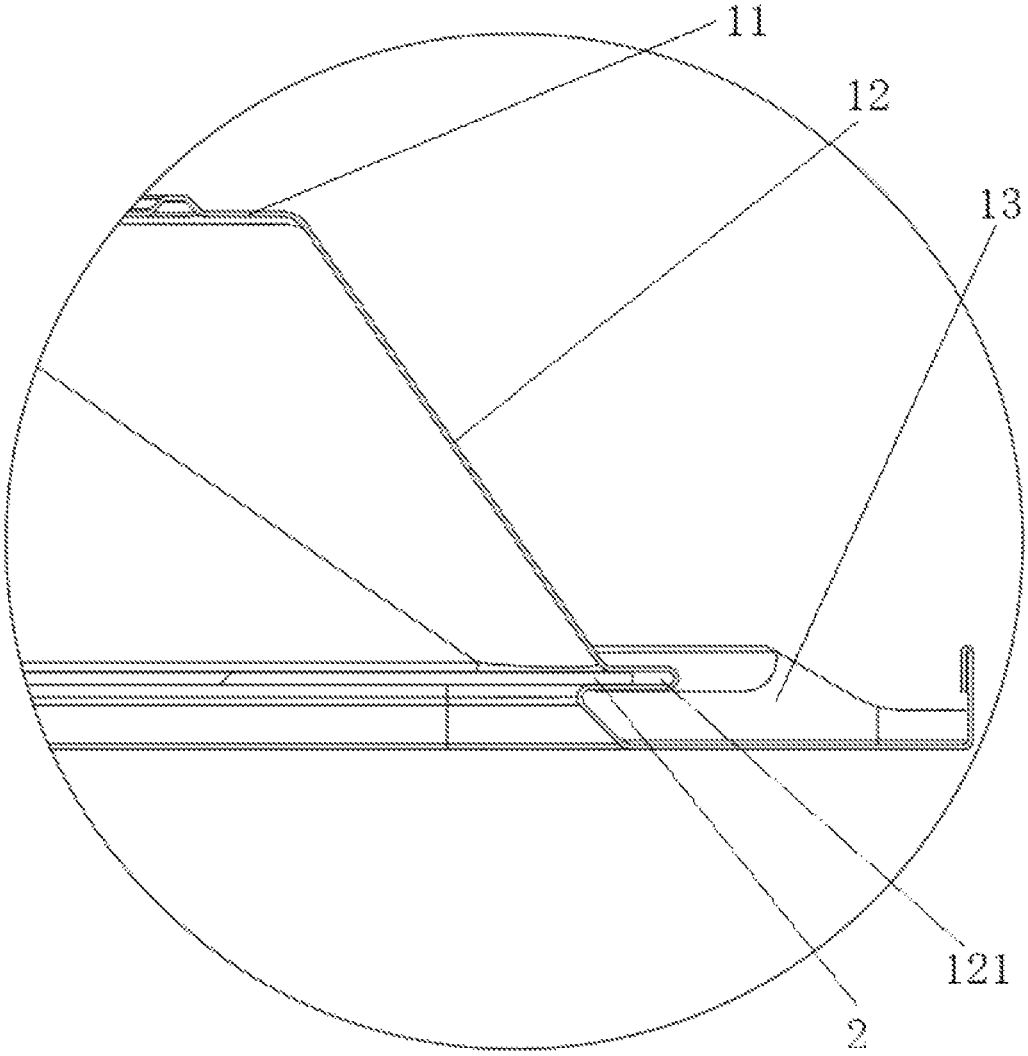
FIG. 9 is a schematic partial enlarged diagram of an integrated lamp panel face frame after installation of a diffusion plate and pressing according to the present disclosure.

In the embodiment, the diffusion plate 2 may be installed without accessories by providing the pressing groove 121 in the side walls 12 of the lamp panel 1. In addition, an upper inner surface and a lower inner surface of the pressing groove 121 are attached to an upper surface and a lower surface of the diffusion plate 2 after pressing, as shown in FIG. 9, to achieve seamless assembling, thereby preventing dust and foreign matter from entering the lamp panel 1, improving the assembling efficiency, and also improving the assembling quality.

In the embodiment, in order to improve the strength of the lamp panel 1, an installation groove 111 is provided in the base plate 11 of the lamp panel 1 and protrudes outward along an inner wall of the base plate 11, a plurality of reinforcing protrusion structures 112 are provided on the installation groove 111 and protrude toward interior of the lamp panel 1, and an annular reinforcing convex rib 113 is provided on the base plate 11 of the lamp panel 1 and protrudes outward along the installation groove 111.

The plurality of reinforcing protrusion structures 112 are distributed on the installation groove 111 in an array, and the reinforcing protrusion structures 112 may also be distributed on the installation groove 111 evenly or according to other rules, such that an aesthetic effect is achieved while uniform strength distribution of the base plate 11 of the lamp panel 1 is achieved.

In addition, shapes of the installation groove 111, the reinforcing protrusion structures 112 and the reinforcing convex rib 113 may be optimized in order to optimize appearance and shape of the lamp panel 1.

For example, the installation groove 111 may be designed as a circular, oval, or square shape, and when the shape of the installation groove 111 is set as a square, edges of the installation groove 111 may be designed as a wave, square wave or zigzag shape. The reinforcing protrusion structures 112 and the reinforcing convex rib 113 may also be designed as a circular, oval, or square shape, the specific structure may be adjusted according to a design scheme of the lamp panel 1, and other patterns may also be adopted, which will not be described here.

Embodiment 2

Figure 10:
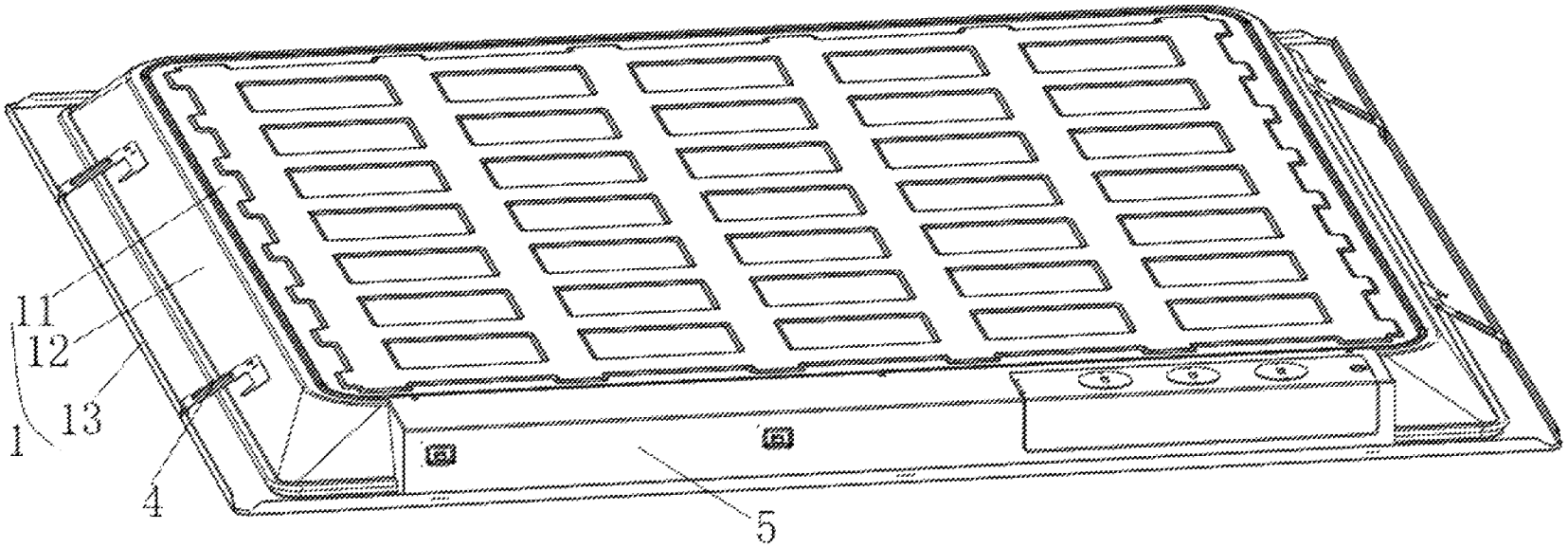
FIG. 10 is a schematic structural diagram of an integrated non-face frame panel light according to the present disclosure.
Figure 11:
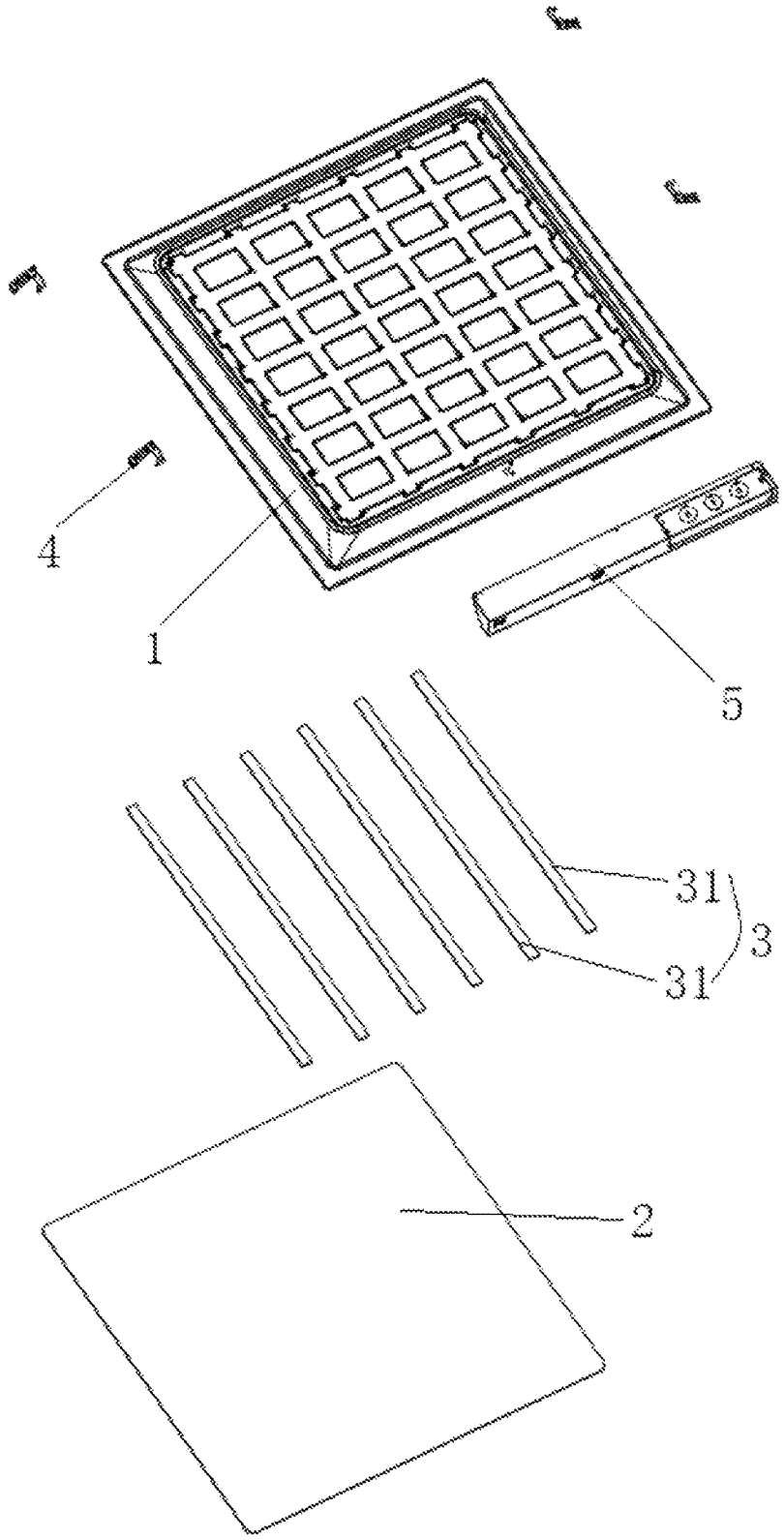
FIG. 11 is an exploded view of an integrated non-face frame panel light according to the present disclosure.

The embodiment discloses an integrated non-face frame panel light, including, as shown in FIG. 10 and FIG. 11, the integrated lamp panel face frame in Embodiment 1, a diffusion plate 2 and an LED light source 3. The diffusion plate 2 is embedded in a pressing groove 121 of the integrated lamp panel face frame, and the LED light source 3 is fixedly installed in an installation groove 111 of the integrated lamp panel face frame.

In the embodiment, the diffusion plate 2 is an acrylic diffusion plate, a PS diffusion plate, a PP diffusion plate or a PC diffusion plate, etc., and material of the diffusion plate 2 is not limited herein.

Figure 12:
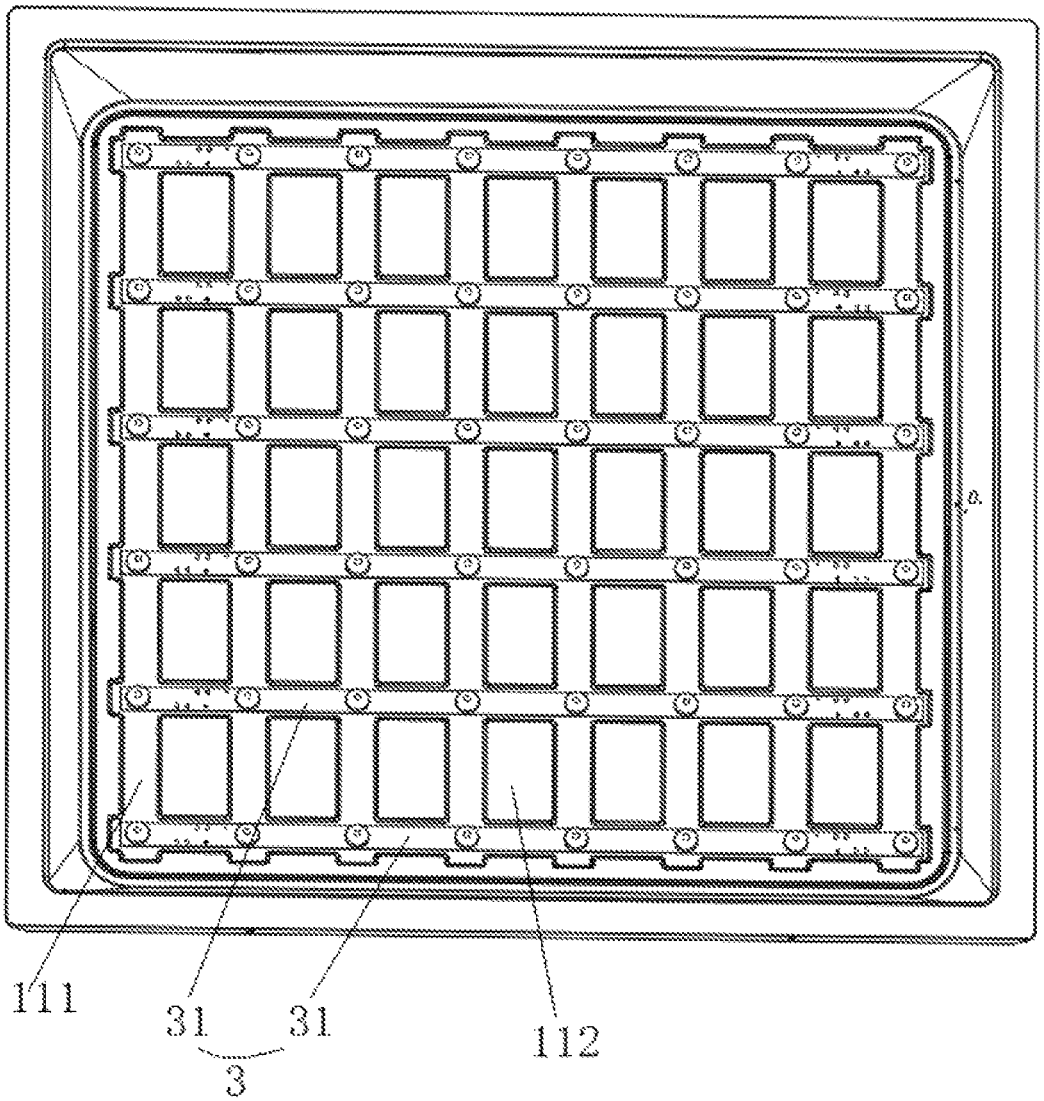
FIG. 12 is a schematic diagram of installation of an LED light source of an integrated non-face frame panel light according to the present disclosure.

In the embodiment, as shown in FIG. 12, the LED light source 3 includes a plurality of strip light panels 31, the plurality of strip light panels 31 are disposed in parallel, and every two adjacent strip light panels 31 are spaced by a column or a row of reinforcing protrusion structures 112.

Since the plurality of reinforcing protruding structures 112 have the same structure and are distributed in an array, the spacing between every two adjacent strip light panels 31 is the same, uniform installation is achieved, and thus luminance of the integrated non-face frame panel light is uniform.

Figure 13:
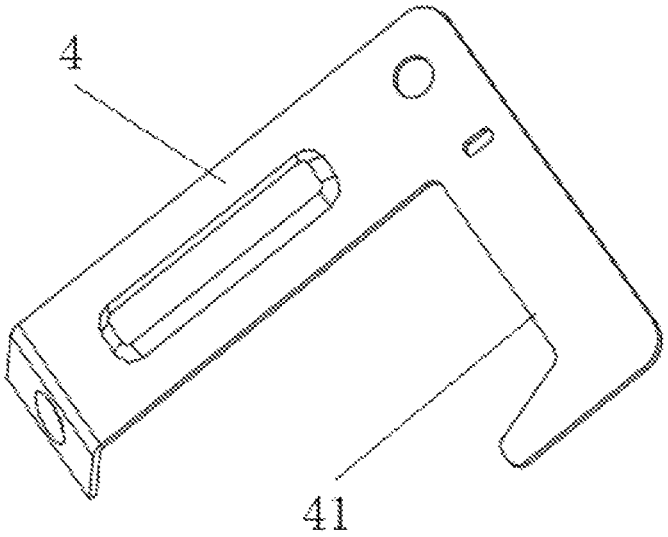
FIG. 13 is a schematic structural diagram of an installation spring buckle of an integrated non-face frame panel light according to the present disclosure.

In the embodiment, the integrated non-face frame panel light further includes installation spring buckles 4. As shown in FIG. 13, one ends of the installation spring buckles 4 are fixedly connected to a face frame installation part 13, and the other ends of the installation spring buckles 4 are bent horizontally to form clasps 41.

Figure 14:
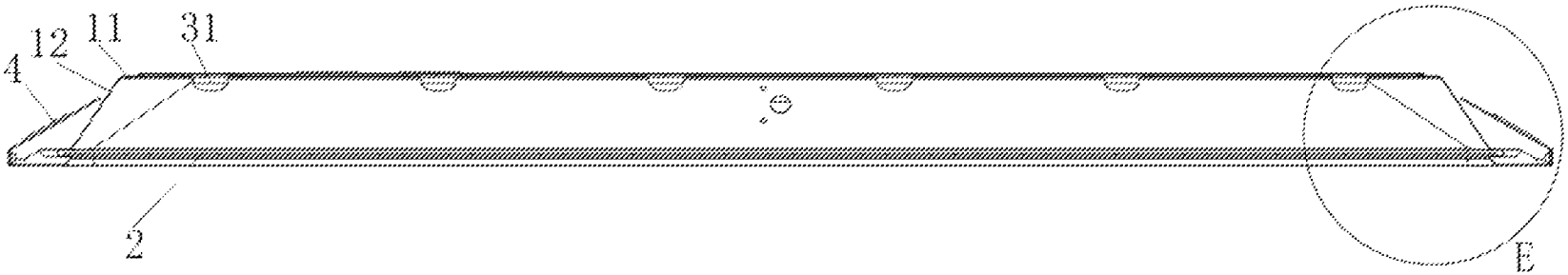
FIG. 14 is a schematic front cross-sectional view of an integrated non-face frame panel light according to the present disclosure.
Figure 15:
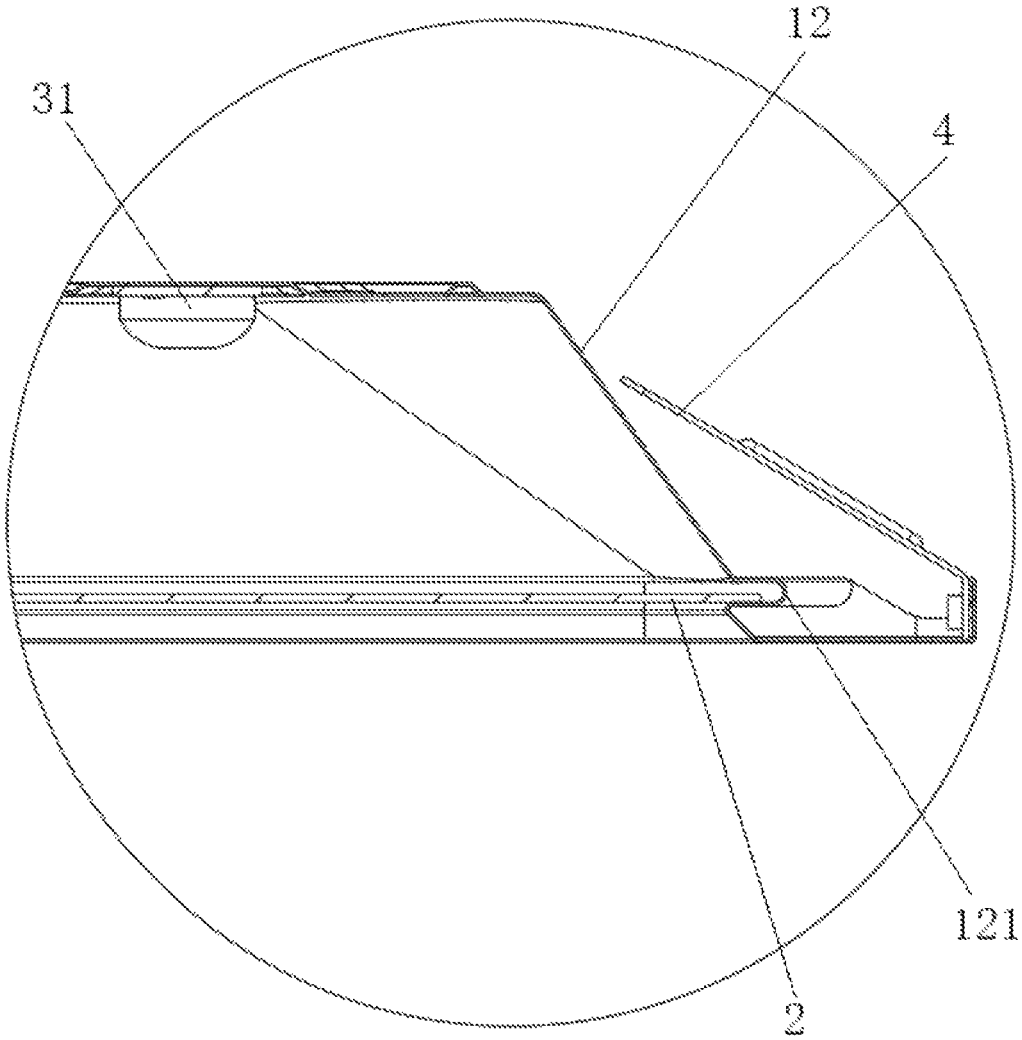
FIG. 15 is a structural enlarged view of E in an integrated non-face frame panel light according to the present disclosure.
Figure 16:
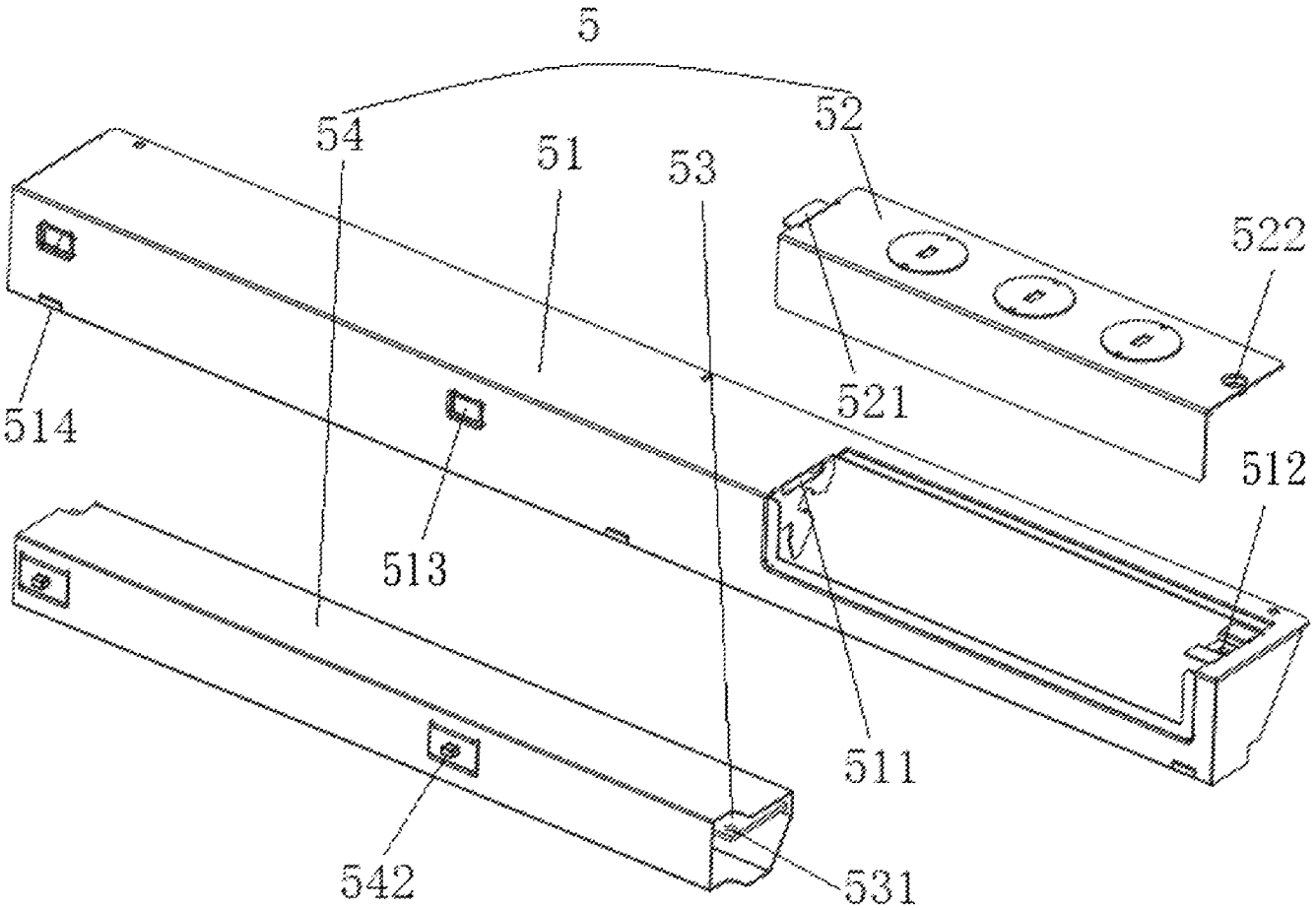
FIG. 16 is an exploded view of a driving power box in an integrated non-face frame panel light according to the present disclosure.
Figure 17:
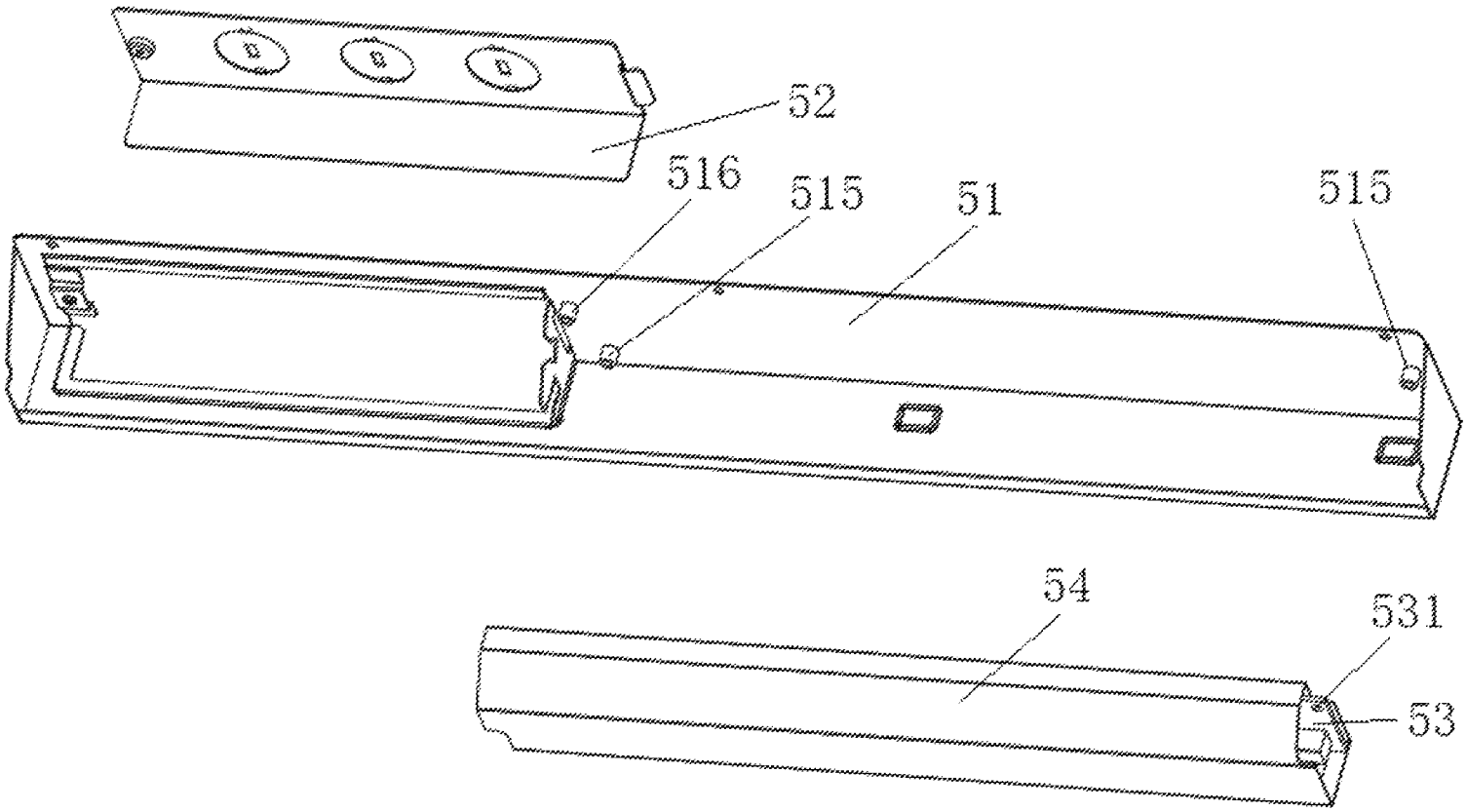
FIG. 17 is an exploded view of a driving power box in an integrated non-face frame panel light according to the present disclosure.
Figure 18:
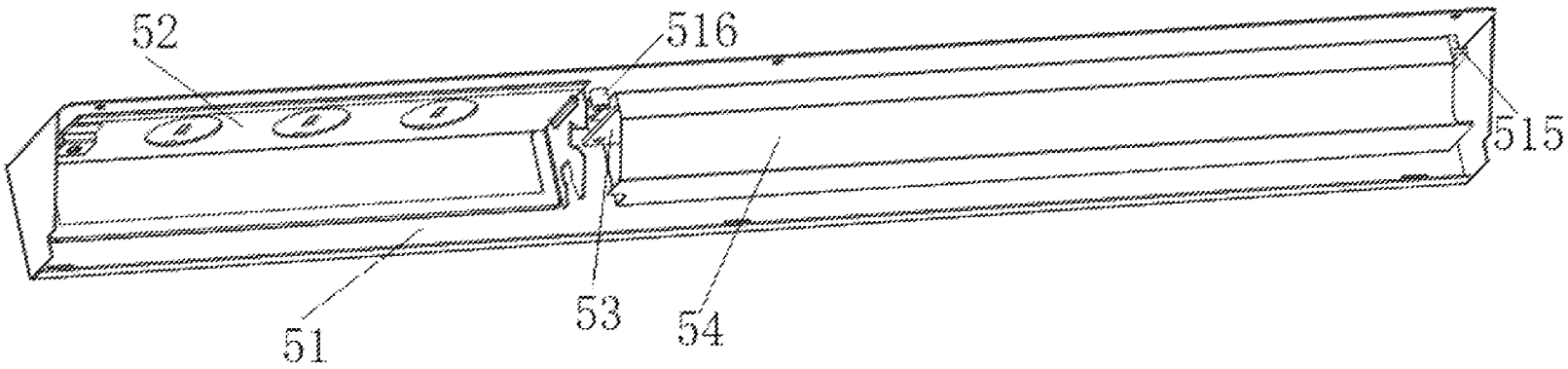
FIG. 18 is a schematic structural diagram of a driving power box in an integrated non-face frame panel light according to the present disclosure.
Figure 19:
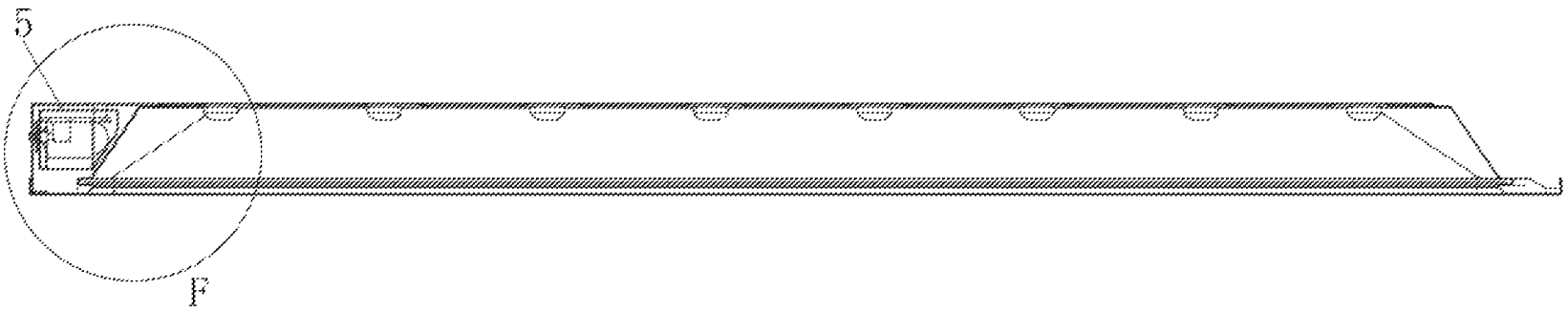
FIG. 19 is a schematic structural diagram of an integrated non-face frame panel light after installation of a driving power box according to the present disclosure.
Figure 20:
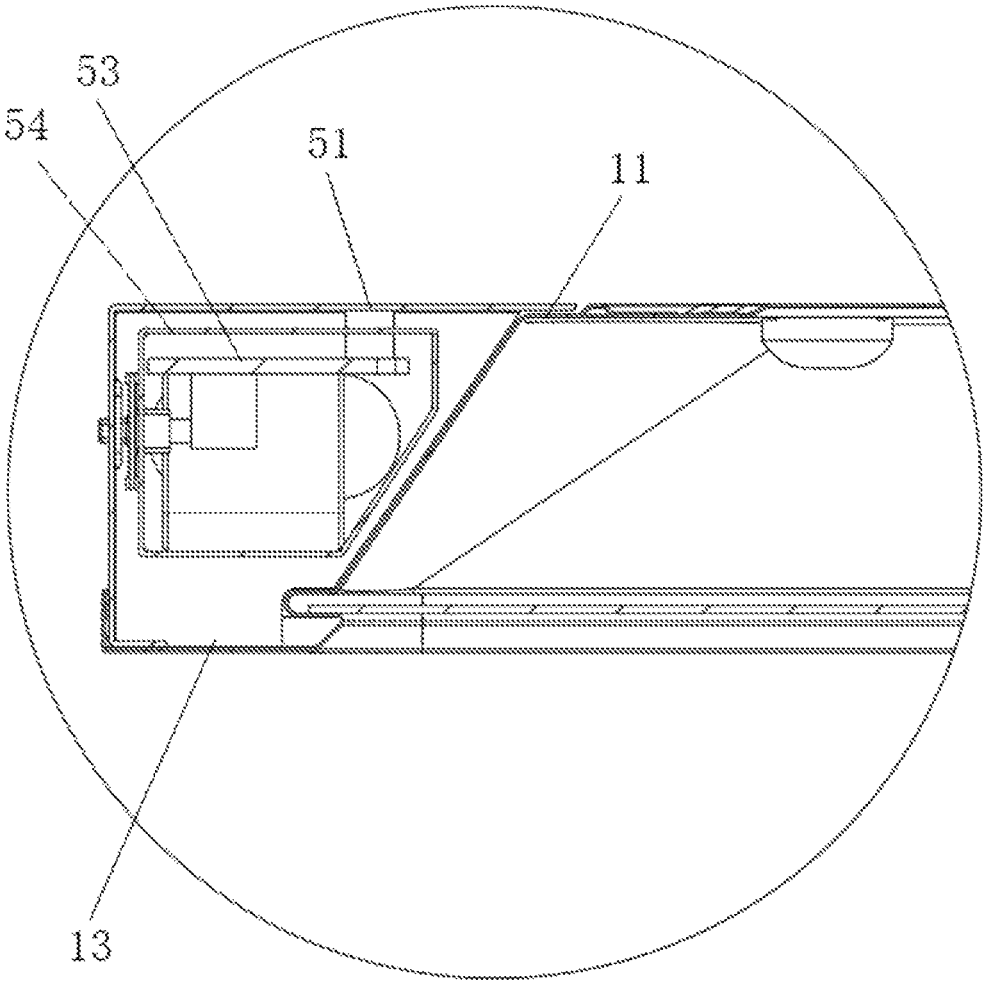
FIG. 20 is a structural enlarged view of F in an integrated non-face frame panel light according to the present disclosure.

As shown in FIG. 14 and FIG. 15, the installation spring buckles 4 are divided into two groups, and are fixed to opposite sides of the face frame installation part 13 respectively. After the integrated non-face frame panel light is embedded into a ceiling, the clasps 41 of the installation spring buckles 4 may be buckled to an upper surface of the ceiling, such that the integrated non-face frame panel light can be installed more safely and is not prone to falling off.

In the embodiment, the integrated non-face frame panel light further includes a driving power box 5, the driving power box 5 is connected to the LED light source 3, and the driving power box 5 is installed at the face frame installation part 13 of the integrated lamp panel face frame and fixedly connected to the integrated lamp panel face frame.

Specifically, the driving power box 5 is embedded in the face frame installation part 13 and fixedly connected to a base plate 11 of the lamp panel 1.

According to the integrated non-face frame panel light of the embodiment, by using the integrated lamp panel face frame in Embodiment 1, the assembling process is optimized, the assembling efficiency and product quality are improved, the transportation dimension is decreased, and the transportation cost and transshipment cost are reduced.

Embodiment 3

On the basis of Embodiment 2, the embodiment further discloses a structure of the driving power box 5 of the integrated non-face frame panel light.

In the embodiment, the structure of the driving power box 5 is as shown in FIG. 16 to FIG. 20: the driving power box 5 includes a box body 51, a cover 52 and a power panel 53, a through groove matched with the cover 52 is provided in an upper surface of one end of the box body 51, the cover 52 is installed in the through groove and is fixedly connected to the box body 51, and the power panel 53 is installed in the box body 51 via a partition plate 54.

In the embodiment, since the driving power box 5 is installed at the face frame installation part 13 of the integrated lamp panel face frame and attached to side walls 12 of the integrated lamp panel face frame, and the side walls 12 of the integrated lamp panel face frame are inclined, the box body 51 is set in an L shape, a horizontal surface of the box body 51 is fixedly connected to the base plate 11 of the integrated lamp panel face frame, a vertical surface of the box body 51 is buckled to or fixedly connected to the face frame installation part 13 of the integrated lamp panel face frame, and side plates are disposed at two ends of the box body 51.

Specifically, the horizontal surface of the box body 51 and the base plate 11 of the integrated lamp panel face frame are fixedly connected with screws, protrusions 514 or buckle grooves are provided in an outer side of the vertical surface of the box body 51, and correspondingly, limiting grooves matched with the protrusions 514 or clasps matched with the buckle grooves are provided on an inner side face of an outer wall of the face frame installation part 13, so as to achieve buckle limitation.

The through groove is also L-shaped, and similarly, the cover 52 is L-shaped. A first connecting part 511 and a second connecting part 512 are provided at opposite ends of an upper surface of the through groove respectively in the length direction of the box body 51. A third connecting part 521 matched with the first connecting part 511 and a fourth connecting part 522 matched with the second connecting part 512 are provided at opposite ends of an upper surface of the cover 52 respectively. The cover 52 is connected to the first connecting part 511 and the second connecting part 512 of the box body 51 via the third connecting part 521 and the fourth connecting part 522.

In addition, in the embodiment, the partition plate 54 is set in a square shape to protect the power panel 53. Screw holes 531 are provided in the power panel 53, studs 515 are provided on the box body 51, and the power panel 53 is fixedly connected to the box body 51 via the matched screw holes 531 and studs 515. At the same time, limiting posts 516 for limiting the partition plate 54 are further provided on the box body 51. After the power panel 53 is installed, keys 542 thereof penetrate through the partition plate 54 and through holes 513 of the box body 51 in sequence, so as to control the integrated non-face frame panel light.

Embodiment 4

The embodiment discloses an assembling method of an integrated non-face frame panel light. The method is used for assembling the integrated non-face frame panel light in Embodiment 2, and includes the following steps:

S10. Install a plurality of strip light panels 31 of an LED light source 3 in an installation groove 111 of a lamp panel 1 fixedly and sequentially.

When the integrated non-face frame panel light is assembled, the LED light source 3 is installed first, and may be fixed by gluing, welding, or screwing. Referring to Embodiment 2, the plurality of strip light panels 31 are sequentially installed and fixed in a pressing groove 121 of an integrated lamp panel face frame.

S20. Install a diffusion plate 2 in the pressing groove 121, and pressing the pressing groove 121, such that an upper inner surface and a lower inner surface of the pressing groove 121 are attached to an upper surface and a lower surface of the diffusion plate 2 respectively after pressing.

After the LED light source 3 is installed, the diffusion plate 2 is installed in the pressing groove 121, and then the pressing groove 121 is pressed with a corresponding mold, such that the upper inner surface and the lower inner surface of the pressing groove 121 can be attached to the upper surface and the lower surface of the diffusion plate 2 respectively after pressing to achieve seamless assembling, thereby preventing dust and foreign matter from entering the lamp panel 1, improving the assembling efficiency, and also improving the assembling quality.

S30. Install a driving power box 5 at a face frame installation part 13 of the integrated lamp panel face frame fixedly.

After the diffusion plate 2 is installed, the assembled driving power box 5 is fixedly installed at the face frame installation part 13.

S40. Connect installation spring buckles 4 to the face frame installation part 13 of the integrated lamp panel face frame fixedly.

Finally, the installation spring buckles 4 are fixed with screws, such that assembling of the integrated non-face frame panel light is completed. The whole assembling process is simple and convenient to implement, the number of assembling accessories is reduced, the assembling efficiency is improved, and the product quality is also improved.

It is apparent that the above embodiments of the present disclosure are merely illustrative of the present disclosure for purposes of clarity and are not intended to limit the implementations of the present disclosure. For those of ordinary skill in the art, various other modifications or variations can be made on the basis of the above description. All embodiments need not to be, and cannot be, exhaustive. Any modifications, equivalent replacements and improvements made within the spirit and principle of the present disclosure shall fall within the protection scope of the claims of the present disclosure.

What is claimed is:

1. An integrated lamp panel face frame, comprising an integrally molded lamp panel, a base plate of the lamp panel and four side walls of the lamp panel being inclined, a deformable pressing groove protruding towards outer walls of the lamp panel along inner walls of the side walls of the lamp panel for installing a diffusion plate, wherein the deformable pressing groove is reduced in width upon pressing after the diffusion plate is installed into the deformable pressing groove such that an upper inner surface and a lower inner surface of the deformable pressing groove are attached to an upper surface and a lower surface of the diffusion plate after pressing to achieve seamless assembling between the deformable pressing groove and the diffusion plate; and a face frame installation part being provided by bending ends of the side walls of the lamp panel towards the base plate of the lamp panel.

2. The integrated lamp panel face frame according to claim 1, wherein the deformable pressing groove is provided in parallel with the base plate of the lamp panel, and a cross section of the deformable pressing groove is in a U shape.

3. The integrated lamp panel face frame according to claim 1, wherein a width of the deformable Dressing groove is greater than a thickness of the diffusion plate before being pressed to facilitate installation of the diffusion plate.

4. The integrated lamp panel face frame according to claim 1, wherein slope notches are provided in four corners of the face frame installation part.

5. The integrated lamp panel face frame according to claim 1, wherein an installation groove is provided in the base plate of the lamp panel and protrudes outward along an inner wall of the base plate, a plurality of reinforcing protrusion structures are provided on the installation groove and protrude toward an interior of the lamp panel, and an annular reinforcing convex rib is provided on the base plate of the lamp panel and protrudes outward along the installation groove.

6. The integrated lamp panel face frame according to claim 5, wherein the plurality of reinforcing protrusion structures are distributed on the installation groove in an array.

7. An integrated non-face frame panel light, comprising the integrated lamp panel face frame according to claim 6, the diffusion plate and an LED light source, the diffusion plate being embedded in a deformable pressing groove of the integrated lamp panel face frame, and the LED light source being fixedly installed in the installation groove of the integrated lamp panel face frame.

8. The integrated non-face frame panel light according to claim 7, wherein the LED light source comprises a plurality of strip light panels, the plurality of strip light panels are disposed in parallel, and every two adjacent strip light panels are spaced by a column or a row of the reinforcing protrusion structures.

9. The integrated non-face frame panel light according to claim 7, further comprising installation spring buckles, one ends of the installation spring buckles being fixedly connected to the face frame installation part, and other ends of the installation spring buckles being bent horizontally to form clasps.

10. The integrated non-face frame panel light according to claim 7, further comprising a driving power box, the driving power box being connected to the LED light source, and the driving power box being installed at the face frame installation part of the integrated lamp panel face frame and fixedly connected to the integrated lamp panel face frame.

11. An assembling method of an integrated non-face frame panel light, used for assembling the integrated non-face frame panel light according to claim 10, and comprising the following steps:

installing a plurality of strip light panels of the LED light source in an installation groove of a lamp panel fixedly and sequentially;

installing the diffusion plate in the deformable pressing groove, and pressing the deformable pressing groove, such that the upper inner surface and the lower inner surface of the deformable pressing groove are attached to the upper surface and the lower surface of the diffusion plate respectively after pressing;

installing the driving power box at the face frame installation part of the integrated lamp panel face frame fixedly; and connecting installation spring buckles to the face frame installation part of the integrated lamp panel face frame fixedly.

* * * * *